US008571875B2

(12) United States Patent
Kim et al.

(10) Patent No.: US 8,571,875 B2
(45) Date of Patent: Oct. 29, 2013

(54) METHOD, MEDIUM, AND APPARATUS ENCODING AND/OR DECODING MULTICHANNEL AUDIO SIGNALS

(75) Inventors: Jung-hoe Kim, Seoul (KR); Eun-mi Oh, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 904 days.

(21) Appl. No.: 11/907,398

(22) Filed: Oct. 11, 2007

(65) Prior Publication Data

US 2008/0097766 A1 Apr. 24, 2008

(30) Foreign Application Priority Data

Oct. 18, 2006 (KR) ..... 10-2006-0101580
Aug. 31, 2007 (KR) ..... 10-2007-0088315

(51) Int. Cl.

| | |
|---|---|
| ***G10L 19/00*** | (2013.01) |
| ***G10L 21/04*** | (2013.01) |
| ***G10L 11/00*** | (2006.01) |
| ***G10L 21/00*** | (2013.01) |

(52) U.S. Cl.

USPC ..... 704/500; 704/501; 704/502; 704/503; 704/504; 704/219; 704/200; 704/200.1; 704/201

(58) Field of Classification Search

USPC ..... 704/500–504, 219, 200, 200.1, 201; 381/2, 19, 20, 21, 22, 23; 700/94

See application file for complete search history.

(56) References Cited

U.S. PATENT DOCUMENTS

| | | | | |
|---|---|---|---|---|
| 6,456,966 | B1 * | 9/2002 | Iwabuchi | 704/212 |
| 6,502,069 | B1 * | 12/2002 | Grill et al. | 704/219 |
| 6,529,604 | B1 * | 3/2003 | Park et al. | 381/22 |
| 7,734,473 | B2 * | 6/2010 | Schuijers et al. | 704/503 |
| 7,761,303 | B2 * | 7/2010 | Pang et al. | 704/500 |
| 7,801,735 | B2 * | 9/2010 | Thumpudi et al. | 704/503 |
| 7,991,495 | B2 * | 8/2011 | Pang et al. | 700/94 |
| 8,116,459 | B2 * | 2/2012 | Disch et al. | 381/22 |
| 2004/0049379 | A1 * | 3/2004 | Thumpudi et al. | 704/205 |
| 2004/0247035 | A1 * | 12/2004 | Schroder et al. | 375/253 |
| 2005/0058304 | A1 * | 3/2005 | Baumgarte et al. | 381/98 |
| 2006/0013405 | A1 * | 1/2006 | Oh et al. | 381/23 |
| 2006/0235678 | A1 * | 10/2006 | Kim et al. | 704/200.1 |

(Continued)

OTHER PUBLICATIONS

"Text of second working draft for MPEG Surround", ISO/IEC JTC 1/SC 29/WG 11, No. N7387, Jul. 29, 2005, 140 pages.*

(Continued)

*Primary Examiner* — Edgar Guerra-Erazo
(74) *Attorney, Agent, or Firm* — Staas & Halsey LLP

(57) ABSTRACT

A method, medium, and apparatus encoding and/or decoding a multichannel audio signal. The method includes detecting the type of spatial extension data included in an encoding result of an audio signal, if the spatial extension data is data indicating a core audio object type related to a technique of encoding core audio data, detecting the core audio object type; decoding core audio data by using a decoding technique according to the detected core audio object type, if the spatial extension data is residual coding data, decoding the residual coding data by using the decoding technique according to the core audio object type, and up-mixing the decoded core audio data by using the decoded residual coding data. According to the method, the core audio data and residual coding data may be decoded by using an identical decoding technique, thereby reducing complexity at the decoding end.

20 Claims, 7 Drawing Sheets

```
Syntax                                                          No. of bits   Mnemonic
ResidualData()
{
    for (i=0; i<numOttBoxes+numTttBoxes; i++) {
        if (bsResidualPresent[i]) {
            if (i<numOttBoxes) {
                for (ps=0; ps<numParamSets; ps++) {                           Note 2
                    bsIccDiffPresent[i][ps];                        1         Uimsbf
                    if (bsIccDiffPresent[i][ps]) {
                        for (pb=0; pb<bsResidualBands[i]; pb++) {
                            IccDiff[i][ps][pb] =                    1..7      vlclbf
                                    1Dhuff_dec(hcod1D_ICC_Diff,bsCodeW);      Note 3
                        }
                    }
                }
            }
            tempExtraFrame=numSlots/(bsResidualFramesPerSpatialFrame+1);      Note 4
            for (rf=0; rf<bsResidualFramesPerSpatialFrame; rf++)
500 ——  if (coreAudioObjectType == 22 ) bsac_raw_data_block(); else          Note 8
510 ——  individual_channel_stream(0);                                         Note 1
            if (window_sequence == EIGHT_SHORT_SEQUENCE) &&                   Note 5
                    ((tempExtraFrame == 18) || (tempExtraFrame == 24) ||
                        (tempExtraFrame == 30)) {
520 ————  if (coreAudioObjectType == 22 ) bsac_raw_data_block(); else        Note 8
530 ————  individual_channel_stream(0);                                       Note 1
            }
        }
    }
}
```

Note 1: individual_channel_stream(0) according to MPEG-2 AAC Low Complexity profile bitstream syntax described in subclause 8.3 of ISO/IEC 13818-7.
Note 2: numParamSets is defined by numParamSets = bsNumParamSets + 1.
Note 3: 1Dhuff_dec() is defined in Annex ERROR! ORIGINAL REFERENCE CANNOT BE FOUND..
Note 4: numSlots is defined by numSlots = bsFrameLength + 1. Furthermore the division shall be interpreted as ANSI C integer division.
Note 5: individual_channel_stream(0) determines the value of window_sequence.
Note 8: coreAudioObjectType INDICATES AOT FOR COMPRESSING DOWNMIXED SIGNAL IN MPEG-4 TRANSMISSION.
bsac_raw_data_block() according to MPEG-4 ER BSAC syntax described in subclause xx of ISO/IEC 14496-3.nch SHOULD ALWAYS BE 1

```
Syntax                                                          No. of bits   Mnemonic
ArbitraryDownmixResidualData()
{
    resFrameLength = numSlots /                                               Note 1
    (bsArbitraryDownmixResidualFramesPerSpatialFrame + 1);
    for (i = 0; i < numAacEl; i++) {                                          Note 2
        bsArbitraryDownmixResidualAbs[i]                            1         Uimsbf
        bsArbitraryDownmixResidualAlphaUpdateSet[i]                 1         Uimsbf
        for (rf = 0; rf < bsArbitraryDownmixResidualFramesPerSpatialFrame + 1;
            rf++)
        if (AacEl[i] == 0) {                                                  Note 3
600 ————  if (coreAudioObjectType == 22 ) bsac_raw_data_block(); else        Note 7
610 ————  individual_channel_stream(0);                                       Note 4
            else{
620 ————  if (coreAudioObjectType == 22 ) bsac_raw_data_block(); else        Note 7
630 ————  channel_pair_element();                                            Note 5
            }
            if (window_sequence == EIGHT_SHORT_SEQUENCE) &&                   Note 8
                ((resFrameLength == 18) || (resFrameLength == 24) ||
                (resFrameLength == 30)) {
                if (AacEl[i] == 0) {
640 ————  if (coreAudioObjectType == 22 ) bsac_raw_data_block(); else        Note 7
650 ————  individual_channel_stream(0);                                       Note 4
                else{
660 ————  if (coreAudioObjectType == 22 ) bsac_raw_data_block(); else        Note 7
670 ————  channel_pair_element();                                            Note 5
                }
            }
        }
    }
}
```

Note 1: numSlots is defined by numSlots = bsFrameLength + 1. Furthermore the division shall be interpreted as ANSI C integer division.
Note 2: numAacEl indicates the number of AAC elements in the current frame according to Table 5.
Note 3: AacEl indicates the type of each AAC element in the current frame according to Table 5.
Note 4: individual_channel_stream(0) according to MPEG-2 AAC Low Complexity profile bitstream syntax described in subclause 8.3 of ISO/IEC 13818-7.
Note 5: channel_pair_element(); according to MPEG-2 AAC Low Complexity profile bitstream syntax described in subclause 8.3 of ISO/IEC 13818-7. The parameter common_window is set to 1.
Note 6: The value of window_sequence is determined in individual_channel_stream(0) or channel_pair_element().
Note 7: ???.nch IS DETERMINED BY AacEl

(56) References Cited

U.S. PATENT DOCUMENTS

| | | | | |
|---|---|---|---|---|
| 2006/0239473 | A1* | 10/2006 | Kjorling et al. | 381/98 |
| 2007/0233296 | A1* | 10/2007 | Kim et al. | 700/94 |
| 2007/0236858 | A1* | 10/2007 | Disch et al. | 361/272 |
| 2009/0225991 | A1* | 9/2009 | Oh et al. | 381/17 |

OTHER PUBLICATIONS

Creusere, C.D.; , "Understanding perceptual distortion in MPEG scalable audio coding," Speech and Audio Processing, IEEE Transactions on , vol. 13, No. 3, pp. 422-431, May 2005.*

Martin Wolters et al., "A closer look into MPEG-4 High Efficiency AAC", Audio Engineering Society, Convention Paper Presented at the 115th Convention, Oct. 2003,pp. 1-16.*

J. Breebaart, J. Herre, C. Faller, J. Rödén, F. Myburg, S. Disch, H. Purnhagen, G. Hotho, M. Neusinger, K. Kjörling, W. Oomen: "MPEG spatial audio coding / MPEG Surround: overview and current status", Proc. 119th AES convention, New York, USA, Oct. 2005, Preprint 6447.*

L. Villemoes, J. Herre, J. Breebaart, G. Hotho, S. Disch, H. Purnhagen, K. Kjörling: "MPEG Surround: The forthcoming ISO standard for spatial audio coding", 28th AES Int. Conf.,Piteå, Sweden, 2006.*

ISO/IEC FDIS 23003-1:2006(E), "Information technology—MPEG audio technologies—Part 1:MPEG Surround", Jul. 2006, pp. i-vi, 1-283.

* cited by examiner

FIG. 2

| Syntax | No. of bits | Mnemonic |
|---|---|---|
| SpatialExtensionConfig() | | |
| { | | |
| sacExtNum = 0; | | |
| while (BitsAvailable() >= 8) { | | Note 1 |
| **bsSacExtType**; | 4 | **uimsbf** |
| sacExtType[sacExtNum] = bsSacExtType; | | |
| sacExtNum++; | | |
| cnt = **bsSacExtLen**; | 4 | **uimsbf** |
| if (cnt==15) { | | |
| cnt += **bsSacExtLenAdd**; | 8 | **uimsbf** |
| } | | |
| if (cnt==15+255) { | | |
| cnt += **bsSacExtLenAddAdd**; | 16 | **uimsbf** |
| } | | |
| bitsRead = SpatialExtensionConfigData(bsSacExtType) | | Note 2 |
| nFillBits = 8*cnt-bitsRead; | | |
| **bsFillBits**; | **nFillBits** | **bslbf** |
| } | | |
| } | | |
| } | | |
| Note 1: The function BitsAvailable() returns the number of bits available to be read | | |
| Note 2: SpatialExtensionConfigData() returns the number of bits read. | | |

FIG. 3

| bsSacExtTyp | Meaning |
|---|---|
| 0 | Residual coding data |
| 1 | Arbitrary downmix residual coding data |
| 2 | Arbitrary tree extension data |
| 3 | User data (data delivered to applications outside the scope of this specification) |
| 4..11 | Reserved, SpatialExtensionFrameData() present |
| 12 | Indicating the core Audio Object Type for MPEG-4 Audio |
| 13..15 | Reserved, SpatialExtensionFrameData() not present |

FIG. 4

| Syntax | No. of bits | Mnemonic |
|---|---|---|
| SpatialExtensionConfigData(12) | | |
| { | | |
| **coreAudioObjectType**; | 4 | **uimsbf** |
| } | | |

FIG. 5

| Syntax | No. of bits | Mnemonic |
|---|---|---|
| ResidualData() | | |
| { | | |
| for (i=0; i<numOttBoxes+numTttBoxes; i++) { | | |
| if (bsResidualPresent[i]) { | | |
| if (i<numOttBoxes) { | | |
| for (ps=0; ps<numParamSets; ps++) { | | Note 2 |
| **bsIccDiffPresent[i][ps];** | 1 | **Uimsbf** |
| if (bsIccDiffPresent[i][ps]) { | | |
| for (pb=0; pb<bsResidualBands[i]; pb++) { | | |
| IccDiff[i][ps][pb] = | 1..7 | **vlclbf** |
| 1Dhuff_dec(hcod1D_ICC_Diff,**bsCodeW**); | | Note 3 |
| } | | |
| } | | |
| } | | |
| } | | |
| tempExtraFrame=numSlots/(bsResidualFramesPerSpatialFrame+1); | | Note 4 |
| for (rf=0; rf<bsResidualFramesPerSpatialFrame; rf++) | | |
| 500 if (coreAudioObjectType == 22 ) bsac_raw_data_block(); else | | Note 6 |
| 510 individual_channel_stream(0); | | Note 1 |
| if (window_sequence == EIGHT_SHORT_SEQUENCE) && | | Note 5 |
| ((tempExtraFrame == 18) \|\| (tempExtraFrame == 24) \|\| | | |
| (tempExtraFrame == 30)) { | | |
| 520 if (coreAudioObjectType == 22 ) bsac_raw_data_block(); else | | Note 6 |
| 530 individual_channel_stream(0); | | Note 1 |
| } | | |
| } | | |
| } | | |
| } | | |
| } | | |

Note1: individual_channel_stream(0) according to MPEG-2 AAC Low Complexity profile bitstream syntax described in subclause 6.3 of ISO/IEC 13818-7.

Note 2: numParamSets is defined by numParamSets = bsNumParamSets + 1.

Note 3: 1Dhuff_dec() is defined in Annex ERROR! ORIGINAL REFERENCE CANNOT BE FOUND..

Note 4: numSlots is defined by numSlots = bsFrameLength +1. Furthermore the division shall be interpreted as ANSI C integer division.

Note 5: individual_channel_stream(0) determines the value of window_sequence.

Note 6: coreAudioObjectType INDICATES AOT FOR COMPRESSING DOWNMIXED SIGNAL IN MPEG-4 TRANSMISSION. bsac_raw_data_block() according to MPEG-4 ER BSAC syntax described in subclause xx of ISO/IEC 14496-3.nch SHOULD ALWAYS BE 1

FIG. 6

| Syntax | No. of bits | Mnemonic |
|---|---|---|
| ArbitraryDownmixResidualData() | | |
| { | | |
| resFrameLength = numSlots / (bsArbitraryDownmixResidualFramesPerSpatialFrame + 1); | | Note 1 |
| for (i = 0; i < numAacEl; i++) { | | Note 2 |
| **bsArbitraryDownmixResidualAbs[i]** | **1** | **Uimsbf** |
| **bsArbitraryDownmixResidualAlphaUpdateSet[i]** | **1** | **Uimsbf** |
| for (rf = 0; rf < bsArbitraryDownmixResidualFramesPerSpatialFrame + 1; rf++) | | |
| if (AacEl[i] == 0) { | | Note 3 |
| 600 if (coreAudioObjectType == 22 ) bsac_raw_data_block(); else | | Note 7 |
| 610 individual_channel_stream(0); | | Note 4 |
| else{ | | |
| 620 if (coreAudioObjectType == 22 ) bsac_raw_data_block(); else | | Note 7 |
| 630 channel_pair_element(); | | Note 5 |
| } | | |
| if (window_sequence == EIGHT_SHORT_SEQUENCE) && ((resFrameLength == 18) \|\| (resFrameLength == 24) \|\| (resFrameLength == 30)) { | | Note 6 |
| if (AacEl[i] == 0) { | | |
| 640 if (coreAudioObjectType == 22 ) bsac_raw_data_block(); else | | Note 7 |
| 650 individual_channel_stream(0); | | Note 4 |
| else{ | | |
| 660 if (coreAudioObjectType == 22 ) bsac_raw_data_block(); else | | Note 7 |
| 670 channel_pair_element(); | | Note 5 |
| } | | |
| } | | |
| } | | |
| } | | |
| } | | |

Note 1: numSlots is defined by numSlots = bsFrameLength + 1. Furthermore the division shall be interpreted as ANSI C integer division.
Note 2: numAacEl indicates the number of AAC elements in the current frame according to Table 5.
Note 3: AacEl indicates the type of each AAC element in the current frame according to Table 5.
Note 4: individual_channel_stream(0) according to MPEG-2 AAC Low Complexity profile bitstream syntax described in subclause 6.3 of ISO/IEC 13818-7.
Note 5: channel_pair_element(); according to MPEG-2 AAC Low Complexity profile bitsream syntax described in subclause 6.3 of ISO/IEC 13818-7. The parameter common_window is set to 1.
Note 6: The value of window_sequence is determined in individual_channel_stream(0) or channel_pair_element().
Note 7: ???.nch IS DETERMINED BY AacEl

METHOD, MEDIUM, AND APPARATUS ENCODING AND/OR DECODING MULTICHANNEL AUDIO SIGNALS

CROSS-REFERENCE TO RELATED APPLICATIONS

This application claims the benefits of Korean Patent Application No. 10-2006-0101580, filed on Oct. 18, 2006, and Korean Patent Application No. 10-2007-0088315, filed on Aug. 31, 2007, in the Korean Intellectual Property Office, the disclosures of which are incorporated herein in their entirety by reference.

BACKGROUND

1. Field

One or more embodiments of the present invention relate to a method, medium, and apparatus encoding and/or decoding multichannel audio signals, and more particularly, to a method, medium, and apparatus encoding and/or decoding a residual signal used to up-mix an audio signal.

2. Description of the Related Art

A moving picture experts group (MPEG) surround encoding technique is used to compress audio data in relation to spatial sources. The MPEG surround encoding technique allows an audio signal, compressed according to MPEG audio layer-3 (MP3), MPEG-4 advanced audio coding (AAC), or MPEG-4 high efficiency (HE)-AAC, to be converted into an encoded multichannel surround audio signal. The MPEG surround encoding technique has advantages over other encoding techniques in that this technique maintains backward compatibility to existing stereo equipment, and can be used to reduce bitrates, i.e., a transmission speed, desired for high quality multichannel audio compression while using existing equipment.

According to MPEG surround encoding standards, a core audio signal is conventionally encoded by using any one encoding technique from among bit sliced arithmetic coding (BSAC), AAC, and MP3, while corresponding residual signals are encoded only according to AAC.

Accordingly, when such a core audio signal is encoded with an encoding technique other than AAC, according to the MPEG surround standards, the core audio signal and a residual signal would be encoded by using different encoding techniques. Accordingly, at the decoding end, the core audio signal and the residual signal should be decoded through different decoding techniques. Briefly, herein, the use of the terms encoding technique and encoding method are used interchangeably, with the particular discussion below using the term 'technique' for simplicity of discussion to distinguish a method of the present invention from such encoding methods or techniques.

Thus, the inventors of the present invention have discovered that that there is a desire for a method, medium, and apparatus to attempt to overcome such drawbacks and/or problems potentially resulting from such conventionally required different encoding techniques.

SUMMARY

One or more embodiments of the present invention provide a method, medium, and apparatus decoding a multichannel audio signal, capable of reducing complexity at the decoding end when a residual signal is decoded.

One or more embodiments of the present invention further provide a method, medium, and apparatus encoding a multichannel audio signal, capable of reducing complexity at the encoding end when a residual signal is encoded.

Additional aspects and/or advantages will be set forth in part in the description which follows and, in part, will be apparent from the description, or may be learned by practice of the invention.

According to an aspect of the present invention, there is provided a method of decoding a multichannel audio signal, the method including: detecting a type of spatial extension data included in an encoding result of an audio signal; if the spatial extension data includes data indicating a core audio object type related to a method of encoding core audio data, detecting the core audio object type; decoding the core audio data by using a decoding method according to the detected core audio object type; if the spatial extension data includes residual coding data, decoding the residual coding data by using the decoding method according to the core audio object type; and up-mixing the decoded core audio data by using the decoded residual coding data.

According to another aspect of the present invention, there is provided a computer readable recording medium having embodied thereon a computer program for executing a method of decoding a multichannel audio signal, wherein the method includes: detecting a type of spatial extension data included in an encoding result of an audio signal; if the spatial extension data includes data indicating a core audio object type related to a method of encoding core audio data, detecting the core audio object type; decoding the core audio data by using a decoding method according to the detected core audio object type; if the spatial extension data includes residual coding data, decoding the residual coding data by using the decoding method according to the core audio object type; and up-mixing the decoded core audio data by using the decoded residual coding data.

According to another aspect of the present invention, there is provided an apparatus for decoding a multichannel audio signal, the apparatus including: a spatial extension data type detecting unit detecting a type of spatial extension data included in an encoding result of an audio signal; a core audio object type detecting unit, if the spatial extension data includes data indicating a core audio object type related to a method of encoding core audio data, detecting the core audio object type; a core audio data decoding unit decoding the core audio data by using a decoding method according to the detected core audio object type; a residual coding data decoding unit, if the spatial extension data includes residual coding data, decoding the residual coding data by using the decoding method according to the core audio object type; and an up-mixing unit up-mixing the decoded core audio data by using the decoded residual coding data.

According to another aspect of the present invention, there is provided a method of encoding a multichannel audio signal, the method including: generating core audio data and residual data by down-mixing an input audio signal; encoding the core audio data by using a predetermined encoding method; encoding the residual data by using the predetermined encoding method according to a core audio object type related to the method by which the core audio data is encoded; and outputting the encoded core audio data and the encoded residual data as an encoding result of the audio signal.

According to another aspect of the present invention, there is provided an apparatus encoding a multichannel audio signal, the apparatus including: a down-mixing unit generating core audio data and residual data by down-mixing an input audio signal; a core audio data encoding unit encoding the core audio data by using a predetermined encoding method; a residual data encoding unit encoding the residual data by using the predetermined encoding method according to a core audio object type related to the method by which the core audio data is encoded; and a multiplexing unit outputting the encoded core audio data and the encoded residual data as an encoding result of the audio signal.

BRIEF DESCRIPTION OF THE DRAWINGS

These and/or other aspects and advantages will become apparent and more readily appreciated from the following description of the embodiments, taken in conjunction with the accompanying drawings of which:

FIG. 2 illustrates a syntax file for detecting a spatial extension data type, according to an embodiment of the present invention;

FIG. 3 illustrates a table including assigned values corresponding to "bsSacExtType" illustrated in FIG. 2, according to an embodiment of the present invention;

FIG. 4 illustrates a syntax file for reading a core audio object type, according to an embodiment of the present invention;

FIG. 5 illustrating a syntax file for decoding residual coding data, according to an embodiment of the present invention;

FIG. 6 illustrates a syntax file for decoding arbitrary down-mix residual data, according to an embodiment of the present invention;

DETAILED DESCRIPTION OF EMBODIMENTS

Figure 1:
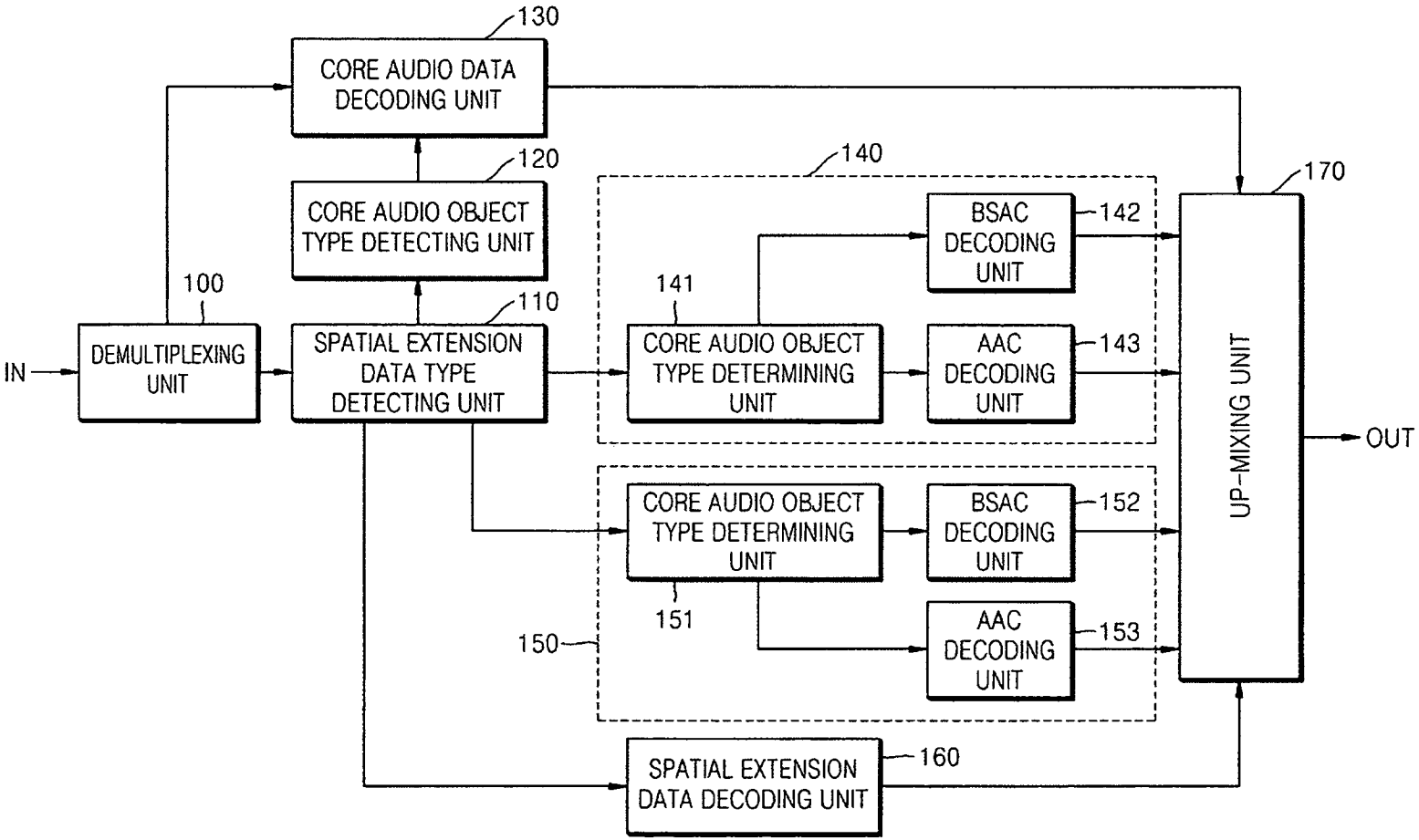
FIG. 1 illustrates an apparatus decoding a multichannel audio signal, according to an embodiment of the present invention.

Reference will now be made in detail to embodiments, examples of which are illustrated in the accompanying drawings, wherein like reference numerals refer to like elements throughout. In this regard, embodiments of the present invention may be embodied in many different forms and should not be construed as being limited to embodiments set forth herein. Accordingly, embodiments are merely described below, by referring to the figures, to explain aspects of the present invention.

FIG. 1 illustrates an apparatus decoding a multichannel audio signal, according to an embodiment of the present invention. Herein, the term apparatus should be considered synonymous with the term system, and not limited to a single enclosure or all described elements embodied in single respective enclosures in all embodiments, but rather, depending on embodiment, is open to being embodied together or separately in differing enclosures and/or locations through differing elements, e.g., a respective apparatus/system could be a single processing element or implemented through a distributed network, noting that additional and alternative embodiments are equally available.

Referring to FIG. 1, the apparatus decoding a multichannel audio signal, according to an embodiment, may include a demultiplexing unit 100, a spatial extension data type detecting unit 110, a core audio object type detecting unit 120, a core audio data decoding unit 130, a residual coding decoding unit 140, an arbitrary down-mix residual coding data decoding unit 150, a spatial extension data decoding unit 160, and an up-mixing unit 170, for example. Here, up-mixing is a concept that includes generating plural signals, e.g., stereo signals, of two or more channels from a single signal, e.g., a mono signal. Similarly, down-mixing is a corresponding concept that includes encoding plural signals, e.g., stereo signals, of two or more channels into a single channel, e.g., a mono channel.

Thus, here, the demultiplexing unit 100 may receive a bitstream, e.g., from an encoding end through an input terminal IN, and demultiplex the bitstream.

FIG. 2 illustrates an example syntax file for detecting a spatial extension data type, according to an embodiment of the present invention. Further, for example, FIG. 3 illustrates a table showing assignment of values corresponding to "bsSacExtType" illustrated in FIG. 2, according to an embodiment of the present invention. Thus, according to one embodiment, an operation of the spatial extension data type detecting unit 110 will now be further explained in greater detail with reference to FIGS. 1 through 3.

The spatial extension data type detecting unit 110 may detect the type of spatial extension data, e.g., in a header, of data which is demultiplexed by the demultiplexing unit 100. More specifically, the spatial extension data type detecting unit 110 may detect the type of the spatial extensional data in the header of the demultiplexed data according to a function SpatialExtensionConfig( ), illustrated in FIG. 2, for example. Here, in the illustrated function SpatialExtensionConfig( ), "bsSacExtType" indicates the type of spatial extension data.

Referring to FIG. 3, in this embodiment, if "bsSacExtType" is a "0", spatial extension data may be indicated as being residual coding data; if "bsSacExtType" is "1", spatial extension data may be indicated as being arbitrary down-mix residual coding data; and if "bsSacExtType" is "12", spatial extension data may be indicated as being a core audio object type of moving picture experts group (MPEG)-4 audio, for example. Here, the core audio object type is defined as an audio object type for correspondingly encoding a signal which is down-mixed at an encoding end. However, these particular indications and audio object types are just for one or more embodiments of the present invention, noting that a person of ordinary skill in the art of the present invention should understand that alternate embodiments are equally available.

In other words, if 0 is assigned to "bsSacExtType", the spatial extension data type detecting unit 110 may determine that the type of spatial extension data is residual coding data. If 1 is assigned to "bsSacExtType", the spatial extension data type detecting unit 110 may determine that the type of spatial extension data is arbitrary down-mix residual coding data, and if 12 is assigned to "bsSacExtType", the spatial extension data type detecting unit 110 may determine that the type of spatial extension data is data indicating the core audio object type of MPEG-4 audio.

An operation of an apparatus for decoding an audio signal according to a spatial extension data type detected by the spatial extension data type detecting unit 110 will now be explained in greater detail with further reference to FIG. 4.

First, the case where the spatial extension data type detected by the spatial extension data type detecting unit 110 is data indicating the core audio object type of MPEG-4 audio will be explained, i.e., "bsSacExtType" is 12, according to the above indication examples.

FIG. 4 illustrates a syntax file, for example, for reading a core audio object type, according to an embodiment of the present invention. Accordingly, according to an embodiment, an operation of the core audio object type detecting unit 120 will now be explained with reference to FIGS. 1 and 4.

As a result of detecting the type of spatial extension data in the spatial extension data type detecting unit 110, if it is determined that the spatial extension data is data indicating the core audio object type of MPEG-4 audio, the core audio object type detecting unit 120 may detect the core audio object type.

More specifically, the core audio object type detecting unit 120 may read the core audio object type by using a function "SpatialExtensionConfigData(12)", for example, illustrated in FIG. 4. Here, "coreAudioObjectType" indicates the core audio object type of MPEG-4 audio.

Referring again to FIG. 1, the core audio data decoding unit 130 may decode core audio data, as demultiplexed by the demultiplexing unit 100. More specifically, the core audio data decoding unit 130 may decode the demultiplexed core audio data according to the core audio object type detected by the core audio object type detecting unit 120, for example.

As described above, the core audio object "type" is defined as an audio object type that is used for encoding a signal during a down-mixing at an encoding end. Here, the core audio data can be encoded by using any one encoding technique from among a variety of encoding techniques, such as bit sliced arithmetic coding (BSAC), (MP3), advanced audio coding (AAC), and MPEG audio layer-3 (MP3), at the encoding end, for example. Here, the referenced BSAC, AAC, and MP3 encoding techniques are just some of the available encoding techniques available in embodiments of the present invention, and a person of ordinary skill in the art of the present invention should understand that core audio data can be encoded by using a variety of encoding techniques.

Secondly, the case where the spatial extension data type detected by the spatial extension data type detecting unit 110 is residual coding data will now be explained, i.e., "bsSacExtType" is 0, according to the above indication examples.

FIG. 5 illustrating a syntax file, for example, for decoding residual coding data, according to an embodiment of the present invention. Accordingly, according to an embodiment, an operation of the residual coding data decoding unit 140 will now be explained with reference to FIGS. 1 and 5.

The residual coding data decoding unit 140 may include a first core audio object type determining unit 141, a first BSAC decoding unit 142, and a first AAC decoding unit 143, for example, and may decode residual coding data, according to an embodiment of the present invention.

As a result of the detecting of the type of spatial extension data in the spatial extension data type detecting unit 110, for example, if it is determined that the spatial extension data is residual coding data, the first core audio object type determining unit 141 may further determine whether the core audio object type is the 'BSAC' type.

Referring to FIG. 5, in this example, since the value/variable of "22" is assigned as the core audio object type of 'BSAC', the first core audio object type determining unit 141 may determine whether "coreAudioObjecType", detected by the core audio object type detecting unit 120, corresponds to "22".

As a result of the determination in the first core audio object type determining unit 141, if the core audio object type corresponds to 'BSAC', the first BSAC decoding unit 142 may decode a residual signal according to a 'BSAC' decoding technique. For example, in an embodiment, the first BSAC decoding unit 142 can be executed according to an operation indicated by reference numeral 500 or 520 in the syntax illustrated in FIG. 5. Here, in this operation indicated by the reference numeral 500 or 520, the first BSAC decoding unit 142 decodes residual coding data according to a function bsac_raw_data_block( ) defined in MPEG-4 ER BSAC. Here, further, in this embodiment, "nch" of bsac_raw_data_block ( ) may always desirably be set as 1. In this case, "nch" indicates the number of channels.

If it is determined by the first core audio object type determining unit 141 that the core audio object type does not correspond to the 'BSAC' type, the first AAC decoding unit 143 may decode residual coding data according to an AAC decoding technique. For example, in this embodiment, the first AAC decoding unit 143 can be executed according to an operation indicated by reference numeral 510 or 530 illustrated in FIG. 5. Here, in this operation indicated by the reference numeral 510 or 530, the first AAC decoding unit 143 decodes residual coding data according to individual_channel_stream(0) defined in "MPEG-2 AAC low complexity profile bitstream syntax" described in subclause 6.3 of ISO/IEC 13818-7, for example.

However, this described AAC technique is just one embodiment for the first AAC decoding unit 143, noting that alternative embodiments are equally available.

Thus, if it is determined by the first core audio object type determining unit 141 that the core audio object type does not correspond to the 'BSAC' type, residual coding data can be decoded in the first AAC decoding unit 143 according to a decoding technique corresponding to the core audio object type detected by the first core audio object type determining unit 141. For example, if the core audio object type detected by the first core audio object type determining unit 141 is 'MP3', residual coding data may be decoded by 'MP3' in the first AAC decoding unit 143.

Thus, core audio data decoded in the core audio data decoding unit 130 can be up-mixed to a multichannel signal, by using residual coding data decoded in the first BSAC decoding unit 142 or the first AAC decoding unit 143.

Thirdly, the case where the spatial extension data type, e.g., detected by the spatial extension data type detecting unit 110 is an arbitrary down-mix residual coding data will now be explained, i.e., "bsSacExtType" is 1, according to the above indication examples.

FIG. 6 illustrates a syntax file, for example, for decoding arbitrary down-mix residual data, according to an embodiment of the present invention. According to an embodiment, an operation of the arbitrary down-mix residual coding data decoding unit 150 will now be explained with reference to FIGS. 1 and 6.

The arbitrary down-mix residual coding data decoding unit 150 may include a second core audio object type determining unit 151, a second BSAC decoding unit 152, and a second AAC decoding unit 153, for example, and decode arbitrary down-mix residual coding data, according to an embodiment of the present invention.

As a result of an example determination by the second core audio object type determining unit 151, if the core audio object type corresponds to the 'BSAC' type, the second BSAC decoding unit 152 may decode arbitrary down-mix residual coding data according to a 'BSAC' decoding technique. For example, the second BSAC decoding unit 152 may be executed according to at least one of operations indicated by reference numerals 600, 620, 640, and 660 of the syntax illustrated in FIG. 6. In at least one of the operations indicated by the reference numerals 600, 620, 640, and 660, for example, the second BSAC decoding unit 152 may decode arbitrary down-mix residual coding data according to a function bsac_raw_data_block( ) defined in MPEG-4 ER BSAC. Here, in such an embodiment, "nch" of bsac_raw_data_block( ) may always desirably be set as 1. In this case, "nch" indicates the number of channels.

If it is determined by the first core audio object type determining unit 151 that the core audio object type does not correspond to the 'BSAC' type, the second AAC decoding unit 152 may decode arbitrary down-mix residual coding data according to an 'AAC' decoding technique. For example, the second AAC decoding unit 153 may be executed by at least one of the operations indicated by the reference numerals 600, 620, 640, and 660. Here, in this example, in the operation indicated by the reference numeral 610 or 650, the second AAC decoding unit 153 may decode arbitrary down-mix residual coding data according to individual_channel_stream (0) defined in "MPEG-2 AAC low complexity profile bitstream syntax" described in subclause 6.3 of ISO/IEC 13818-7, for example. Further, in the operation indicated by the reference numeral 630 or 670, the second AAC decoding unit 153 may decode arbitrary down-mix residual coding data according to channel_pair_element( ) defined in "MPEG-2 AAC low complexity profile bitstream syntax" described in subclause 6.3 of ISO/IEC 13818-7, for example. Here, the parameter "common_window" may desirably be set as 1.

However, similar to above, the referenced AAC is just one embodiment of the second AAC decoding unit 153. If it is determined by the second core audio object type determining unit 151 that the core audio object type does not correspond to the 'BSAC' type, arbitrary down-mix residual coding data may be decoded in the second AAC decoding unit 153 according to a decoding technique corresponding to the core audio object type detected by the second core audio object type determining unit 151. For example, if the core audio object type detected by the second core audio object type determining unit 151 is 'MP3', arbitrary down-mix residual coding data may be decoded by 'MP3' in the second AAC decoding unit 153, again noting that alternative embodiments are equally available.

Thus, again, core audio data decoded in the core audio data decoding unit 130 can be up-mixed to a multichannel signal, by using arbitrary down-mix residual coding data decoded in the second BSAC decoding unit 152 or the second AAC decoding unit 153, for example.

Fourthly, the case where the spatial extension data type, e.g., as detected by the spatial extension data type detecting unit 110, is none of data indicating the core audio object type of MPEG-4 audio, residual coding data, or arbitrary down-mix residual coding data, will now be explained.

The spatial extension data decoding unit 160 may perform decoding by a technique corresponding to the type of spatial extension data detected by the spatial extension data type detecting unit 110. Thus, core audio data decoded in the core audio data decoding unit 130 may be up-mixed to a multichannel signal, by using data decoded in the spatial extension data decoding unit 160, for example.

The up-mixing unit 170, thus, may further up-mix the core audio data decoded in the core audio data decoding unit 130, to a multichannel signal, by using the result decoded in the first and second BSAC decoding units 142 and 152, the first and second ACC decoding units 143 and 153, or the spatial extension data decoding unit 160, for example.

Figure 7:
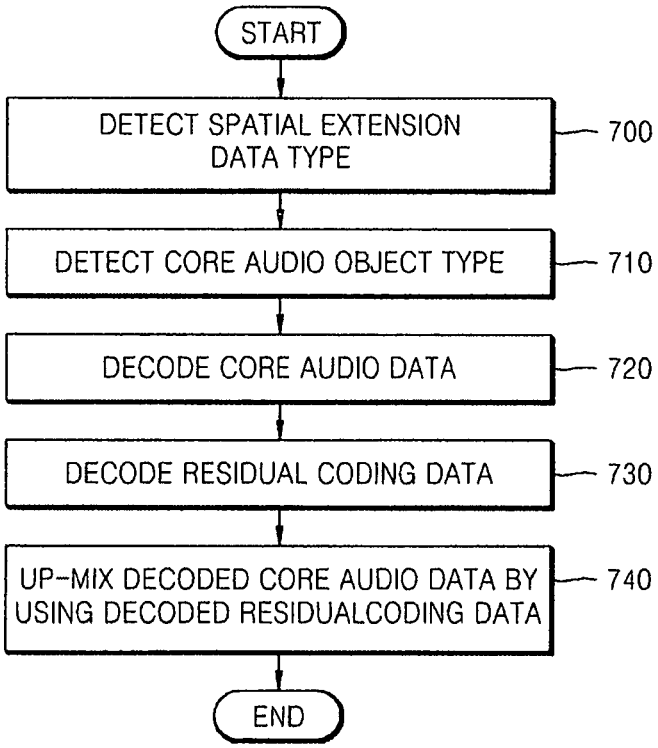
FIG. 7 illustrates a method of decoding a multichannel audio signal, according to an embodiment of the present invention.

FIG. 7 illustrates a method of decoding a multichannel audio signal, according to an embodiment of the present invention.

As only one example, such an embodiment may correspond to example sequential processes of the example apparatus illustrated in FIG. 1, but is not limited thereto and alternate embodiments are equally available. Regardless, this embodiment will now be briefly described in conjunction with FIG. 1, with repeated descriptions thereof being omitted.

In operation 700, the type of spatial extension data included/represented in an encoded audio signal may be detected, e.g., by the spatial extension data type detecting unit 110, for example.

In operation 710, if spatial extension data is data indicating the core audio object type, related to the encoding technique for the corresponding core audio data of the encoded audio signal, the core audio object type may be detected, e.g., by the core audio object type detecting unit 1210, for example.

In operation 720, core audio data may be decoded by using a corresponding decoding technique according to the detected core audio object type, e.g., by the core audio data decoding unit 130, for example.

In operation 730, if spatial extension data is residual coding data, residual coding data may be decoded by using a corresponding decoding technique according to the detected core audio object type, e.g., by the residual coding data decoding unit 140, for example.

In operation 740, the decoded core audio data may then be up-mixed by using residual coding data, e.g., by the up-mixing unit 170, for example.

Here, in an embodiment, if the spatial extension data is arbitrary down-mixed residual coding data, the method of decoding an audio signal may further include an operation for decoding arbitrary down-mix residual coding data by using a decoding technique according to a core audio object type. In this case, the up-mixing unit 170 may, thus, up-mix the decoded core audio data by using decoded residual coding data and decoded arbitrary down-mix residual coding data.

In addition, in an embodiment, if the spatial extension data is data other than data indicating a core audio object type, residual coding data, and arbitrary down-mix residual coding data, the technique of decoding the audio signal may further include an operation for decoding spatial extension data by a decoding technique according to the spatial extension data type. In this case, the up-mixing unit 170 may, thus, up-mix the decoded core audio data by using decoded residual coding data, decoded arbitrary down-mix residual coding data, and decoded spatial extension data.

Figure 8:
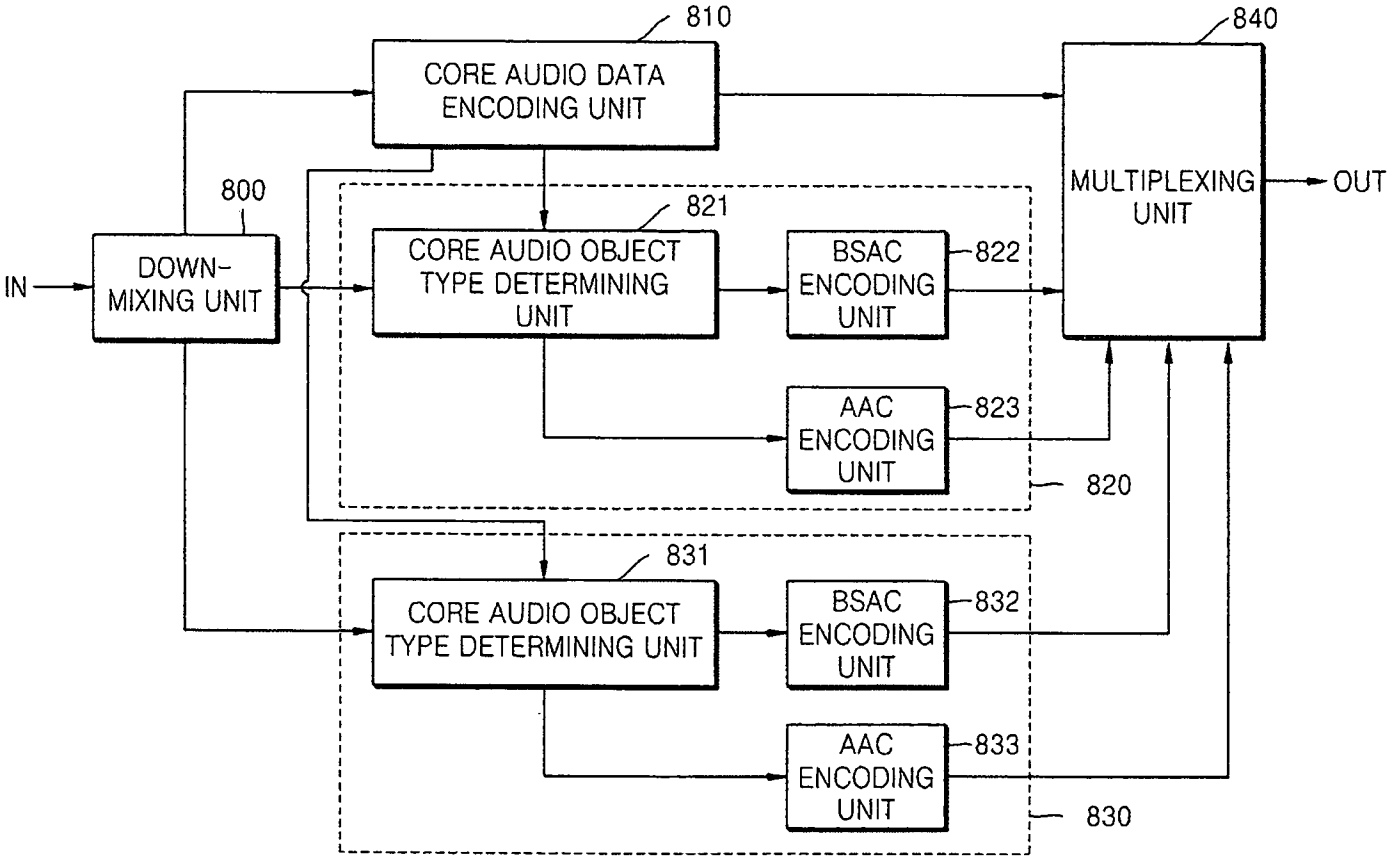
FIG. 8 illustrates an apparatus encoding a multichannel audio signal, according to an embodiment of the present invention.

FIG. 8 illustrates an apparatus encoding a multichannel audio signal, according to an embodiment of the present invention.

Referring to FIG. 8, the apparatus for encoding a multichannel audio signal may include a down-mixing unit 800, a core audio data encoding unit 810, a residual data encoding unit 820, an arbitrary down-mix residual data encoding unit 830, and a multiplexing unit 840, for example.

The down-mixing unit 800 may down-mix an input signal (IN). Here, the input signal (IN) may be a pulse code modulation (PCM) signal, for example, obtained through modulation of an audio signal or an analog voice signal, noting that alternatives are equally available. As noted above, the down-mixing may include the generating of a mono signal of one channel from a stereo signal of two or more channels. By performing such down-mixing, the amount of bits assigned in an encoding process can be reduced.

The core audio data encoding unit 810 may encode core audio data, e.g., as output from the down-mixing unit 800, according to a predetermined encoding technique. Here, the core audio data can be encoded by using any one of a variety of example encoding techniques such as BSAC, AAC, and MP3. Briefly, as noted above, BSAC, AAC, and MP3 are just some embodiments of the present invention, and a person of ordinary skill in the art of the present invention should understand that the core audio data can be encoded by using a variety of encoding techniques, depending on embodiment.

The residual data encoding unit 820 may include a first core audio object type determining unit 821, a first BSAC encoding unit 822, and a first AAC encoding unit 823, for example, and encode residual data.

The first core audio object type 821 may determine a core audio object type related to the encoding technique used in encoding the core audio data, e.g., in the core audio data encoding unit 810, thereby determining the encoding technique for the residual data. For example, if an encoded core audio object type is 'BSAC', the first core audio object type determining unit 821 may determine the encoding technique for the residual data to be a 'BSAC' encoding technique, and if the encoded core audio object type is 'AAC', the first core audio object type determining unit 821 may determine the encoding technique for the residual data to be an 'AAC' encoding technique.

If the determination result of the first core audio object type determining unit 821 indicates that a core audio object type is the 'BSAC' type, the first BSAC encoding unit 822 may encode residual data by the 'BSAC' technique. In this way, the core audio data and the residual data may be encoded by using an identical encoding technique, thereby reducing the complexity at the encoding end compared to conventional systems.

If the determination result of the first core audio object type determining unit 821 indicates that a core audio object type is the 'AAC' type, the first AAC encoding unit 823 may encode residual data by the 'AAC' technique. In this way, the core audio data and the residual data may be encoded by using an identical encoding technique, thereby reducing the complexity at the encoding end compared to conventional system.

However, similar to that discussed above, the 'AAC' technique in the first AAC encoding unit 823 is just one embodiment, and if it is determined by the first core audio object type determining unit 821 that a core audio object type does not correspond to the 'BSAC' type, residual data can be encoded in the first AAC encoding unit 823 by an encoding technique corresponding to a core audio object type detected by the first core audio object type determining unit 821. For example, if the core audio object type detected by the first core audio object type determining unit 821 is an 'MP3' type, residual data can be encoded in the first AAC encoding unit 823 by such an 'MP3' encoding technique.

The arbitrary down-mix residual data encoding unit 830 may include a second core audio object type determining unit 831, a second BSAC encoding unit 832, and a second AAC encoding unit 833, for example, and encode residual data, according to an embodiment of the present invention.

The second core audio object type 831 may determine a core audio object type related to the encoding technique used for the encoded core audio data in the core audio data encoding unit 810, thereby determining the encoding technique for the residual data. For example, if a core audio object type is the 'BSAC' type, the second core audio object type determining unit 831 may determine the encoding technique for the residual data to be a 'BSAC' encoding technique, and if a core audio object type is the 'AAC' type, the first core audio object type determining unit 821 may determine the encoding technique for the residual data to be an 'AAC' encoding technique.

If the determination result of the second core audio object type determining unit 831 indicates that a core audio object type is the 'BSAC' type, the second BSAC encoding unit 832 may encode residual data by the 'BSAC' encoding technique. In this way, the core audio data and the residual data may be encoded by using an identical encoding technique, thereby reducing complexity at the encoding end compared to conventional systems.

If the determination result of the second core audio object type determining unit 831 indicates that the core audio object type is the 'AAC' type, the second AAC encoding unit 833 may encode the residual data by the 'AAC' encoding technique. In this way, the core audio data and the residual data may be encoded by using an identical encoding technique, thereby reducing complexity at the encoding end compared to conventional systems.

However, similar to above, 'AAC' in the second AAC encoding unit 833 is just one embodiment, and if it is determined by the second core audio object type determining unit 831 that a core audio object type does not correspond to the 'BSAC' type, residual data can be encoded in the second AAC encoding unit 833 by an encoding technique corresponding to a core audio object type detected by the second core audio object type determining unit 831. For example, if the core audio object type detected by the second core audio object type determining unit 831 is an 'MP3' type, residual data can be encoded in the second AAC encoding unit 833 by using an 'MP3' technique.

The multiplexing unit 840 may generate a bitstream, for example, by multiplexing encoded results of the core audio data encoding unit 810, encoded results of the first and second BSAC encoding units 822 and 832, and encoded results of the first and second AAC encoding units 823 and 833, and output the example bitstream to an output terminal (OUT).

Figure 9:
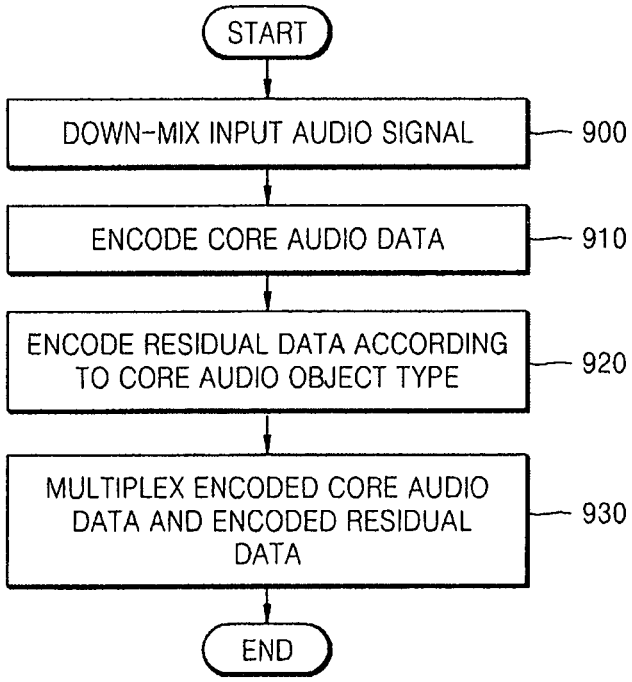
FIG. 9 illustrates a method of encoding a multichannel audio signal, according to an embodiment of the present invention.

FIG. 9 illustrates a method of encoding a multichannel audio signal, according to an embodiment of the present invention.

As only one example, such an embodiment may correspond to example sequential processes of the example apparatus illustrated in FIG. 8, but is not limited thereto and alternate embodiments are equally available. Regardless, this embodiment will now be briefly described in conjunction with FIG. 8, with repeated descriptions thereof being omitted.

In operation 900, an input audio signal may be down-mixed, e.g., by the down-mixing unit 800, thereby generating core audio data and residual data, for example.

In operation 910, the core audio data may be encoded according to a predetermined encoding technique, e.g., by the core audio data encoding unit 810, for example.

In operation 920, the residual data may be encoded by a predetermined encoding technique based on a core audio object type related to the encoding technique used in encoding the core audio data, e.g., by the residual data encoding unit 820, for example.

In operation 930, the encoded core audio data and the encoded residual data may be multiplexed and a result of the multiplexing may be output as the encoded audio signal, e.g., by the multiplexing unit 840, for example.

Above, through operation 900, core audio data, residual data, and arbitrary down-mix residual data can be generated by down-mixing the input audio signal.

Here, based upon the above, in this case, the method of encoding an audio signal, according to an embodiment, may further include an operation of encoding the arbitrary down-mix residual data by using a predetermined encoding technique according to a core audio object type. In this case, the multiplexing unit 940, for example, may multiplex the encoded core audio data, the encoded residual data, and the encoded arbitrary down-mix residual data, and output the result of the multiplexing as the encoding result of the audio signal.

In addition to the above described embodiments, embodiments of the present invention can also be implemented through computer readable code/instructions in/on a recording medium, e.g., a computer readable medium, to control at least one processing element to implement any above described embodiment. The medium can correspond to any medium/media permitting the storing and/or transmission of the computer readable code.

The computer readable code can be recorded/transferred on a medium in a variety of ways, with examples of the medium including recording media, such as magnetic storage media (e.g., ROM, floppy disks, hard disks, etc.) and optical recording media (e.g., CD-ROMs, or DVDs), and transmission media such as media carrying or including carrier waves, as well as elements of the Internet, for example. Thus, the medium may be such a defined and measurable structure including or carrying a signal or information, such as a device carrying a bitstream, for example, according to embodiments of the present invention. The media may also be a distributed network, so that the computer readable code is stored/transferred and executed in a distributed fashion. Still further, as only an example, the processing element could include a processor or a computer processor, and processing elements may be distributed and/or included in a single device.

According to one or more embodiments of the present invention, the decoding method may include: detecting the type of spatial extension data included in an encoding result of an audio signal; if the spatial extension data is data indicating a core audio object type related to a technique for encoding core audio data, detecting the core audio object type; decoding core audio data by a decoding technique according to the detected core audio object type; if the spatial extension data is residual coding data, decoding the residual coding data by the decoding technique according to the core audio object type; and up-mixing the decoded core audio data by using the decoded residual coding data. In this way, the core audio data and the residual coding data may be decoded by an identical decoding technique, thereby reducing complexity at the decoding end compared to conventional systems.

According to one or more embodiments of the present invention, the encoding method may include: generating core audio data and residual data by down-mixing an input audio signal; encoding the core audio data by a predetermined encoding technique; encoding the residual data by the predetermined encoding technique according to a core audio object type related to the technique by which the core audio data is encoded; and outputting the encoded core audio data and the encoded residual data as the encoding result of the audio signal. In this way, the core audio data and the residual data may be encoded by using an identical encoding technique, thereby reducing complexity at the encoding end compared to conventional systems.

While aspects of the present invention has been particularly shown and described with reference to differing embodiments thereof, it should be understood that these exemplary embodiments should be considered in a descriptive sense only and not for purposes of limitation. Any narrowing or broadening of functionality or capability of an aspect in one embodiment should not considered as a respective broadening or narrowing of similar features in a different embodiment, i.e., descriptions of features or aspects within each embodiment should typically be considered as available for other similar features or aspects in the remaining embodiments.

Thus, although a few embodiments have been shown and described, it would be appreciated by those skilled in the art that changes may be made in these embodiments without departing from the principles and spirit of the invention, the scope of which is defined in the claims and their equivalents.

What is claimed is:

1. A method of decoding spatial extension data, the method comprising:

determining a type of spatial extension data included in a bitstream;

if the type of the spatial extension data is determined to be residual coding data, decoding residual coding data based on a first decoding scheme; and if the type of the spatial extension data is determined to be arbitrary down-mixed residual coding data, decoding arbitrary down-mixed residual coding data based on a second decoding scheme.

2. The method of claim 1, further comprising:

decoding core audio data included in the bitstream according to core audio object type; and the decoded core audio data by using at least one of the decoded residual coding data and the decoded arbitrary down-mix residual coding data.

3. The method of claim 1, if the type of the spatial extension data is determined to be data other than data indicating the residual coding data, and the arbitrary down-mix coding data, further comprising decoding the spatial extension data by a decoding scheme according to the type of the spatial extension data.

4. The method of claim 3, further comprising:

up-mixing the decoded core audio data by using at least one of the decoded residual coding data, the decoded arbitrary down-mix residual coding data, and the decoded spatial extension data.

5. The method of claim 1, wherein the first decoding scheme decodes an AAC individual channel stream.

6. The method of claim 1, wherein the second decoding scheme decodes either an AAC individual channel stream or an AAC channel pair elements.

7. A non-transitory computer readable recording medium having embodied thereon a computer program for executing a method of decoding spatial extension data, wherein the method comprises:

determining a type of spatial extension data included in a bitstream;

if the type of the spatial extension data is determined to be residual coding data, decoding residual coding data based on a first decoding scheme; and if the type of the spatial extension data is determined to be arbitrary down-mixed residual coding data, decoding arbitrary down-mixed residual coding data based on a second decoding scheme.

8. An apparatus, including at least one processing device, for decoding spatial extension data, the apparatus comprising:

a spatial extension data type detecting unit determining, using the at least one processing device, a type of spatial extension data included in a bitstream;

a residual coding data decoding unit, if the type of the spatial extension data is determined to be residual coding data, decoding residual coding data based on a first decoding scheme; and an arbitrary down-mix residual coding data decoding unit, if the type of the spatial extension data is determined to be arbitrary down-mixed residual coding data, decoding arbitrary down-mixed residual coding data based on a second decoding scheme.

9. The apparatus of claim 8, further comprising:

a core audio data decoding unit decoding core audio data included in the bitstream according to core audio object type;

up-mixing unit up-mixing the decoded core audio data by using at least one of the decoded residual coding data and the decoded arbitrary down-mix residual coding data.

10. The apparatus of claim 8, if the type of the spatial extension data is determined to be data other than data indicating the residual coding data, and the arbitrary down-mix coding data, further comprising a spatial extension data decoding unit decoding the spatial extension data by using a decoding scheme according to the type of the spatial extension data.

11. The apparatus of claim 10, further comprising:

up-mixing unit up-mixing the decoded core audio data by using at least one of the decoded residual coding data, the decoded arbitrary down-mix residual coding data, and the decoded spatial extension data.

12. The apparatus of claim 8, wherein the first decoding scheme decodes an AAC individual channel stream.

13. The apparatus of claim 8, wherein the second decoding scheme decodes either an AAC individual channel stream or an AAC channel pair elements.

14. A method of encoding spatial extension data, the method comprising:

generating at least one of residual data and arbitrary down-mix residual data by down-mixing an input audio signal;

if the residual data is generated, encoding the residual data by using a first encoding scheme;

if the arbitrary down-mix residual data is generated, encoding the arbitrary down-mix residual data by using a second encoding scheme; and outputting at least one of the encoded residual data and the encoded arbitrary down-mix residual data.

15. The method of claim 14, wherein in the down-mixing of the input audio signal, the core audio data is further generated by down-mixing the input audio signal.

16. The method of claim 15, further comprising:

encoding the generated core audio data, wherein in the outputting of the at least one of the encoded residual data and the encoded arbitrary down-mix residual data outputs the encoded core data and at least one of the encoded residual data and the encoded arbitrary down-mix residual data as the encoding result of the audio signal.

17. An apparatus, including at least one processing device, for encoding spatial extension data, the apparatus comprising:

a down-mixing unit generating, using the at least one processing device, at least one of residual data and arbitrary down-mix residual data by down-mixing an input audio signal;

a residual data encoding unit encoding, if the residual data is generated, the residual data by using a first encoding scheme;

an arbitrary down-mix residual data encoding unit encoding, if the arbitrary down-mix residual data is generated, the arbitrary down-mix residual data by using a second encoding scheme; and a multiplexing unit outputting at least one of the encoded residual data and the encoded arbitrary down-mix residual data.

18. The apparatus of claim 17, wherein the down-mixing unit further generates the core audio data, by down-mixing the input audio signal.

19. The apparatus of claim 18, further comprising:

a core audio data encoding unit encoding the core audio data by using a predetermined encoding method, wherein the multiplexing unit outputs the encoded core data and at least one of the encoded residual data and the encoded arbitrary down-mix residual data as the encoding result of the audio signal.

20. A multi-channel decoding method comprising:

decoding a mono down-mixed signal included in a bitstream;

decoding side information for generating a plurality of channel signals from the decoded mono down-mixed signal, included in the bitstream, in consideration with information indicating whether a residual coding has been applied;

decoding a residual signal included in the bitstream, based on the information indicating whether the residual coding has been applied; and reconstructing the plurality of channel signals by upmixing the mono down-mixed signal using the decoded side information and the decoded residual signal.

* * * * *

UNITED STATES PATENT AND TRADEMARK OFFICE

CERTIFICATE OF CORRECTION

PATENT NO. : 8,571,875 B2
APPLICATION NO. : 11/907398
DATED : October 29, 2013
INVENTOR(S) : Jung-hoe Kim et al.

It is certified that error appears in the above-identified patent and that said Letters Patent is hereby corrected as shown below:

In the Claims

In Column 12, Line 21, In Claim 2, before "the decoded" insert -- up-mixing --.

In Column 14, Line 22, In Claim 18, delete "data," and insert -- data --, therefor.

Signed and Sealed this
Twenty-fifth Day of February, 2014

Michelle K. Lee

Michelle K. Lee
*Deputy Director of the United States Patent and Trademark Office*